United States Patent [19]

Nakajima

[11] Patent Number: 5,067,553

[45] Date of Patent: Nov. 26, 1991

[54] POWDER FEEDER IN CONTINUOUS CASTING

[75] Inventor: Hiromi Nakajima, Osaka, Japan

[73] Assignees: Liner Kabouki Co., Ltd., Osaka; Mitsui & Co., Ltd., Tokyo, both of Japan

[21] Appl. No.: 455,315

[22] PCT Filed: Apr. 25, 1989

[86] PCT No.: PCT/JP89/00436

§ 371 Date: Feb. 20, 1990

§ 102(e) Date: Feb. 20, 1990

[87] PCT Pub. No.: WO89/10221

PCT Pub. Date: Nov. 2, 1989

[30] Foreign Application Priority Data

Apr. 27, 1988 [JP] Japan ..... 63-105765

[51] Int. Cl.[5] ..... B22D 11/10

[52] U.S. Cl. ..... 164/412; 164/417; 266/216

[58] Field of Search ..... 164/417, 418, 270.1, 164/472, 473, 412, 268; 266/216

[56] References Cited

U.S. PATENT DOCUMENTS 4,116,367 9/1978 Kataoka et al. ..... 164/418 X
4,312,399 1/1982 Shinji et al. ..... 164/418
4,632,173 12/1986 Kaneko et al. ..... 164/417

FOREIGN PATENT DOCUMENTS 53-4725 1/1978 Japan .
57-54228 11/1982 Japan .
57-195568 12/1982 Japan ..... 164/473
59-120347 7/1984 Japan ..... 164/270.1
59-229267 12/1984 Japan ..... 164/473
60-49846 3/1985 Japan ..... 164/473
61-11703 4/1986 Japan .
62-270263 11/1987 Japan ..... 164/472

*Primary Examiner*—J. Reed Batten, Jr.
*Attorney, Agent, or Firm*—Birch, Stewart, Kolasch & Birch

[57] ABSTRACT

A powder feeder for continuous casting is provided with a powder container for storing casting powder in the final stage prior to being supplied onto a molten steel surface, and a spreading feeder for spreading the casting powder on the molten steel surface in a mold. The powder container is arranged above the head of an operator in the operator work area, the spreading feeder is supported and manipulated by a robot arm, and powder is supplied to the spreading feeder from the discharge port of the powder container through a flexible transfer path which can follow the movement of the robot arm.

4 Claims, 2 Drawing Sheets

POWDER FEEDER IN CONTINUOUS CASTING

BACKGROUND OF THE INVENTION

This invention relates to an improvement in a powder feeder in continuous casting.

The applicant has proposed a powder feeder in which each discharge port of a plurality of powder storage hoppers is connected to a final-stage powder container for mixing powder through a spring feeder. One end of the spring feeder is provided with an oscillating mechanism and is connected to the discharge port of the final-stage powder container, and the other end of the spring feeder meets the powder receiver in front of the final-stage powder container as a free end. The spring feeder is arranged so as to achieve return movement back and forth relative to the powder receiver (Japanese Patent Publication No. 57-54228).

The applicant has also proposed a tundish car on which is mounted a powder feeder equipped with a pair of spring feeders. The ends of pipe assemblies which extend from the base assemblies of the spring feeders swing horizontally back and forth in opposite directions near the strand nozzles, resulting in improved spreading of the casting powder (Japanese Patent Publication No. 61-11703).

However, the conventional powder feeder is arranged with the final-stage powder container at the same height as the work space of the mold. That is, since the end of the spring feeder provided with the oscillating mechanism is connected to the discharge port of the final-stage powder container, and the other end of the spring feeder meets as a free end to the powder receiver in front of the final-stage powder container, the final-stage powder container is inevitably placed at the same height as the mold and the tundish.

The final-stage powder container thus provided at the same height as the mold height is an obstacle to the casting operation. To remove this obstacle, the powder feeder including the final-stage powder container is arranged on the side opposite to the mold operator.

However, on the side of the continuous casting machine opposite to the operator, dust and molten steel are scattered. Under such conditions, maintenance work is very difficult and safety is a problem.

Furthermore, the relatively simple motion of swinging the conventional spring feeder results in a portion of the molten steel surface on which powder cannot be spread. This is called a dead angle. To remove this dead angle, precision machines must be used, but such use is difficult in the presence of scattered dust and molten steel.

SUMMARY OF THE INVENTION

The present invention solves the above problems by providing a powder feeder in continuous casting which comprises a powder container for storing the casting powder in the final stage, and a spreading feeder for spreading the casting powder on the molten steel surface in the mold. The invention is characterized in that the powder container is arranged higher than the work space of the mold, the spreading feeder is attached to a robot arm, and the spreading feeder and the discharge port of the powder container are connected through a flexible transfer path which can follow the movement of the robot arm.

In addition, a spreading conditions monitoring sensor is arranged on the robot arm.

The powder container for storing the final casting powder of the present invention refers to the second powder container in a configuration where the powder is transferred from a first powder storage container to a second powder container and spread on the mold from there. In a configuration where the powder is directly spread on the mold from a first powder storage container, the powder container for storing the final casting powder refers to the first container.

The robot arm of the present invention comprises a plurality of sections movably connected through joints. The movement of each section is automatically controllable.

The spreading feeder of the present invention can comprise a pneumatic transfer means or a mechanical transfer means such as a spring feeder. Also it is possible to make the spreading feeder itself movable by swinging.

The spreading conditions monitoring sensor of the present invention comprises a sensor for monitoring the spreading conditions on the molten steel surface in the mold. An infrared sensor or thermal sensor for detecting the molten steel exposed section (hot spot) can be used. Since the final-stage powder container of the invention is arranged at a position higher than the working space of the mold, the monitoring sensor can be arranged on the operator side without impairing the operation of the operator. Thus, the powder feeder with robot arm, can be arranged on the operator side thereby avoiding the scattered dust and molten steel of the side opposite the operator. Furthermore, the flexibility of the robot arm permits removal of the dead angle portion of the spreading surface of the mold.

A sensor arranged on the robot arm for monitoring the spreading conditions of casting powder can detect the exposed molten steel part (hot spot). Based on the detection of the sensor, the robot arm is automatically controlled to move the end of the spreading feeder to the hot spot for spreading the casting powder.

DESCRIPTION OF THE PREFERRED EMBODIMENT

Figure 1:
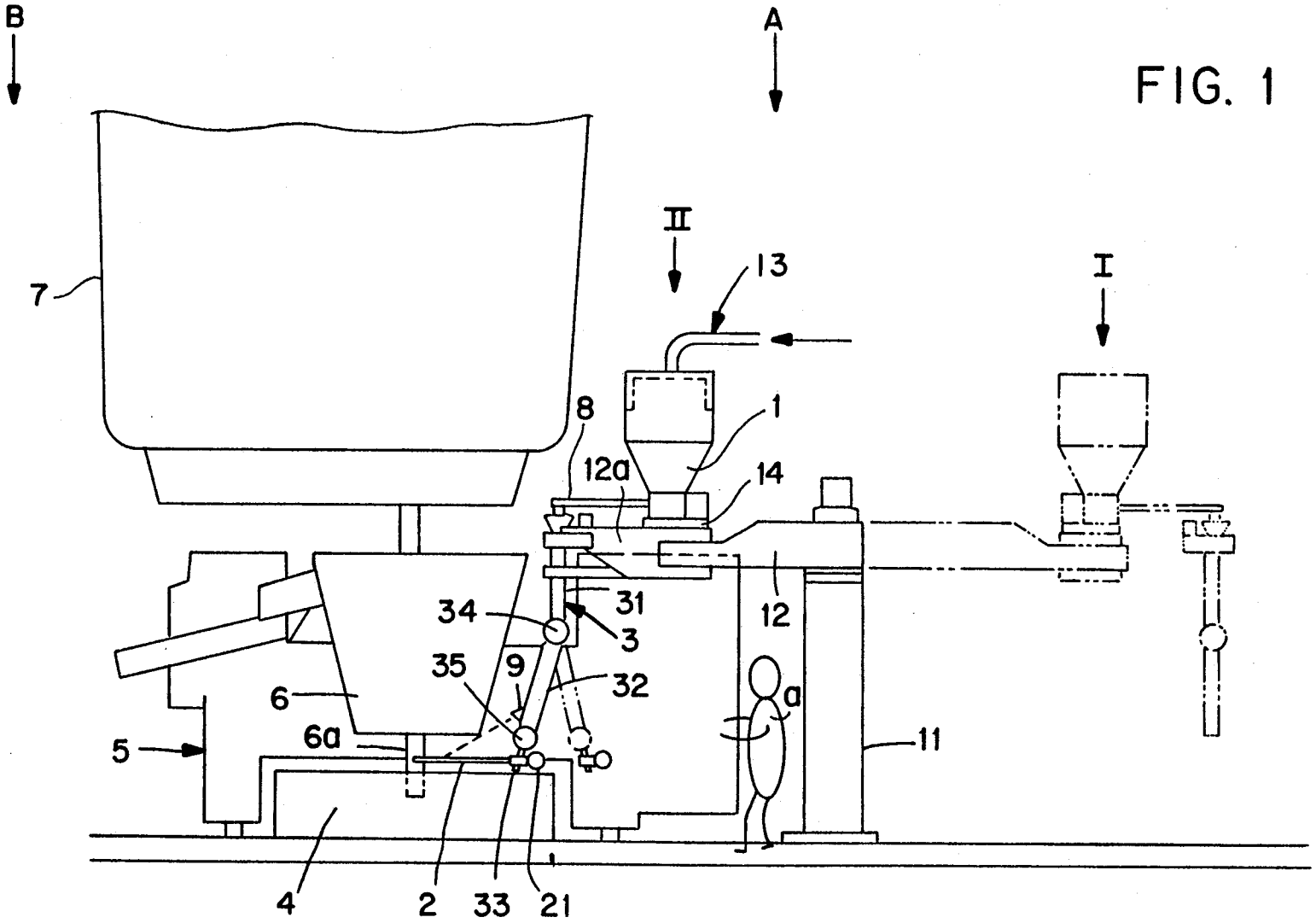
FIG. 1 is a front elevation of an embodiment according to the invention.

With reference to the drawings, an embodiment of the present invention is described.

The powder feeder comprises a final-stage powder container (1), a spreading feeder (2), and a multi-joint robot arm (3).

The final-stage powder container (1) is equipped with a powder inlet line 13 and is mounted on the end of the revolving arm (12) held on the top of a column (11). Final-stage powder container (1) is mounted at a position close to the base end of the tip arm (12*a*). This revolving arm and tip arm are adequately driven by a driving device (not shown). Here, the column (11) is taller than the height of an operator (a), thereby the revolving arm (12) and the final-stage powder container (1) are arranged above the working space of the mold.

Figure 2:
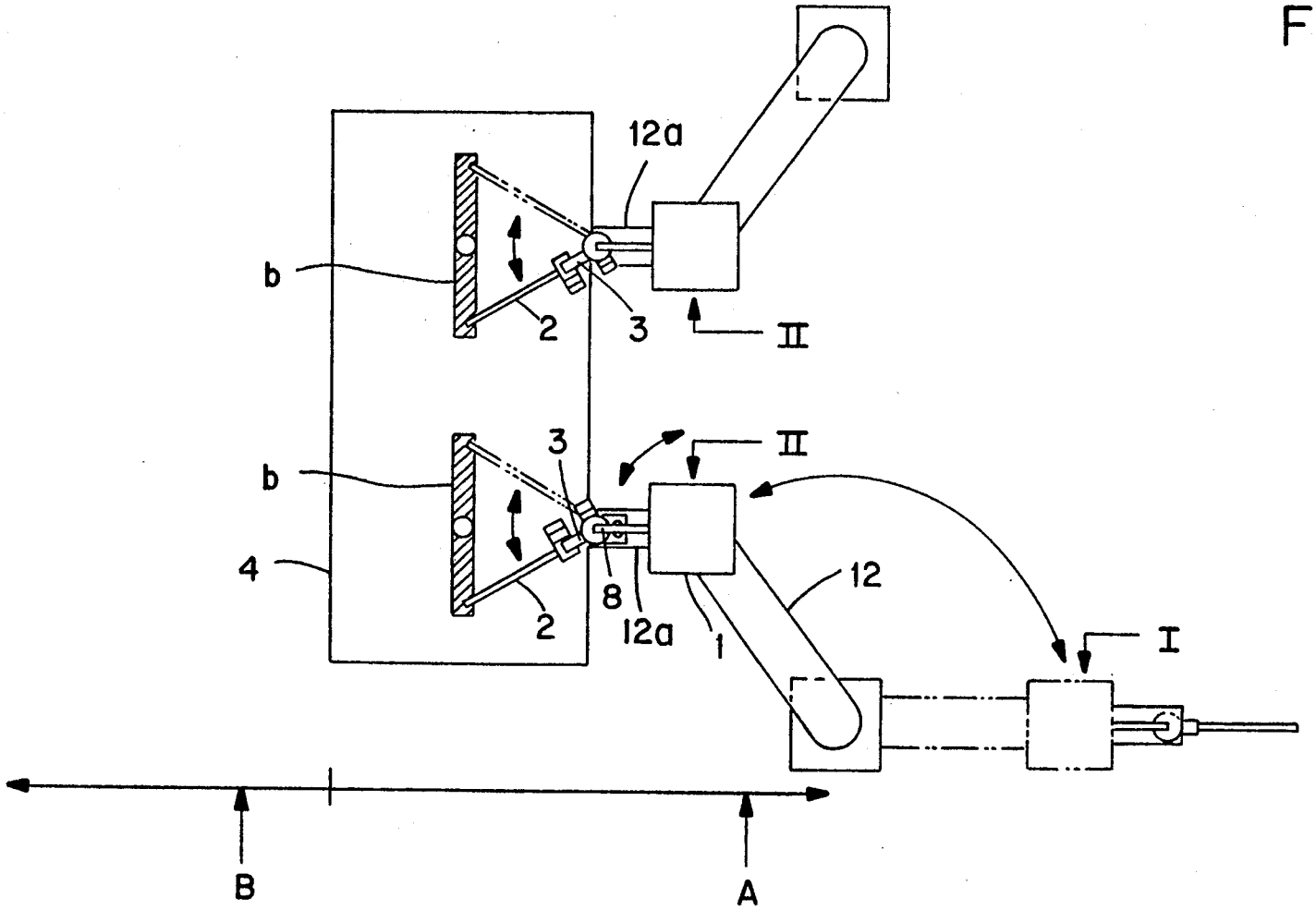
FIG. 2 is a plan view of the same.

Thus, the final-stage powder container (1) can be arranged on the operator side (A), for example, overhead of an operator. In FIG. 2, two final-stage powder containers (1)(1) are arranged on the operator side. In the drawing, (B) indicates the side opposite an operator.

A final-stage powder container (1) is provided with a meter such as a load cell platform scale (14) to weigh the spread quantity of casting powder. Particularly, use of the "loss-in-weight" system permits recording of accurate spreading quantity and higher accuracy of control by a main computer of the continuous casting unit.

The robot arm (3) comprises a base end arm (31), an intermediate arm (32), and a tip hand (33) movably connected by a first joint (34) and a second joint (35). The base end arm (31) is attached to the end of the tip arm (12*a*) of the revolving arm. To the tip hand (33) is mounted a spreading feeder (2). The spreading feeder (2) rotates a spring in a tube by a motor (21) mounted at the tube's base end to spread the casting powder from its tip on to the molten steel surface of the mold. In place of such mechanical means, other transfer means such as pneumatic transfer means can also be used. In the drawings, (5) represents a tundish car with a tundish (6) mounted thereon, a strand nozzle (6*a*) (7) a ladle (7).

To the tip on the intermediate arm (32) of the multi-joint robot arm, a sensor (9) for monitoring the spreading conditions of the casting powder is arranged. This sensor can be an infrared sensor or thermal sensor, and is used for detecting the exposed molten steel (hot spot) in the mold (4). Based on the detection by the sensor, the multi-joint robot arm (3) is moved under automatic control of a computer so as to move the tip of the spreading casting powder feeder (2) to the hot spot for spreading. It is also possible to move the robot arm (3) according to a predetermined program for spreading, not using such a sensor.

The base end of the spreading feeder (2) and the discharge port in the final-stage powder container (1) are connected with a flexible transfer path (8). The flexible transfer path comprises a transfer path having the flexibility to follow the movement of the robot arm, such as flexible pipe. Therefore, non-flexible pipe may be used only in sections of the path where flexibility is not required. The flexible transfer path (8) is arranged from the discharge port of the powder container (1) above the tip arm (12*a*) and along the robot arm (3) to the spreading feeder (2). However, to simplify the drawing, the illustration of the part along the robot arm (3) is omitted. It is possible to equip a feeding device in the flexible transfer path (8) along with the tip arm (12*a*). The casting powder is transferred by said feeding device and dropped by gravity from the final-stage container (1) to the spreading feeder (2). This gravity drop is based on the energy saving concept using the height difference between the final-stage powder container (1) arranged in a high position and the spreading feeder (2) placed in low position, but forced transfer means can be added.

Usage and operation of this embodiment is described as follows.

(i) When the tundish car (5) stops at the position above the mold (4), the revolving arm (12) swings to move the feeder from the stand-by position (I) to the feed position (II).

(ii) The tip arm (12*a*) of the revolving arm turns to face the powder feeder toward the mold.

(iii) The robot arm (3) moves the tip of the spreading feeder (2) above a hot spot to spread the casting powder from its tip. In FIG. 2, the area designated (b) shows the spreading area.

(iv) In replacing the tundish, the powder feeder is returned to the stand-by position by the reverse operation of steps (i) and (ii) mentioned above.

The flexibility of the multi-joint robot arm (3) removes the dead angle above the mold surface, and prevents contact between the spreading feeder (2) and the tundish strand nozzle (6*a*), when the powder feeder is moved.

The present invention is not limited to the above embodiment. If there is a high position such as a deck near the workshop, the final-stage container can be mounted on the deck and the column and revolving arm can be eliminated. The final-stage powder container may be also hung from a high position.

Since the final-stage powder container is arranged in a position higher than the working space on the powder feeder according to the invention, provision of this feeder in the operator side does not interfere with the work of an operator. Since the operator side is free of the scattered dust and molten steel of the side opposite the operator, the following effects are obtained:

(i) Sharp decrease in trouble due to scattered dust and molten steel,;

(ii) Increased ease of maintenance (decreased maintenance personnel) and safety,;

(iii) Improved work environment permitting use of precision instruments such as the robot arm,;

(iv) The easy installation work shortens the construction period,; and (v) The smaller distance to the control board or the operation board making the anti-nozzle provision for CPU wiring easier.

In spreading the casting powder on the mold, the flexibility of the robot arm removes the dead angle on the spreading surface of the mold, and the powder is uniformly spreaded all over the mold surface. And the precision instruments and control equipment used in the robot arm can continue good operation in the good work environment as described in the item (iii) mentioned above. The provision of the spreading conditions monitor sensor on the robot arm, makes complete automation of hot spot detection and spreading possible by computer control of the spreading. This promotes labor saving, stabilizes the continuous casting and improves quality.

This invention can be used in full automation of continuous casting. In further progress of continuous casting of highgrade steel, a powder feeder in continuous casting has been provided which can cope with feed automation of highgrade steel billet size casting powder use.

I claim:

1. A powder feeder for use in continuous casting comprising:

a column;

a revolving tip arm supported by said column;

a powder container for storing final stage casting powder prior to spreading on a molten steel surface in a mold, said powder container being supported by said tip arm and having a discharge end;

a measuring apparatus positioned on said powder container to measure a quantity of powder to be spread on the molten steel surface in the mold;

a robot arm supported by said tip arm;

a spreading feeder for spreading the powder on the molten steel surface in the mold, said spreading feeder positioned lower than said powder container, and supported and manipulated by said robot arm; and a flexible transfer path connecting said discharge end of the powder container to said spreading feeder for supplying powder from said powder container to said spreading feeder, said powder being fed by gravity through said flexible transfer path, and said flexible transfer path being capable of following movements of said robot arm;

said powder container and said measuring apparatus being positioned in an operator work area and higher than an operator's head.

2. The powder feeder for use in continuous casting of claim 1, wherein said robot arm is provided with a spreading conditions monitoring sensor.

3. The powder feeder for use in continuous casting of claim 1, wherein said robot arm comprises:

a base end arm;

an intermediate arm pivotably connected to said base end arm by a first joint; and a tip hand pivotably connected to said intermediate arm by a second joint, said spreading feeder being connected to said tip hand.

4. The powder feeder for use in continuous casting of claim 1, wherein said spreading feeder is provided with an electric motor and a tube through which powder is discharged, said motor operating to spread the powder by rotating a spring located inside said tube.

* * * * *